United States Patent [19]

Grinde

[11] Patent Number: 4,981,452

[45] Date of Patent: Jan. 1, 1991

[54] SURFACE DRIVE OUTBOARD WITH IMPROVED TRANSMISSION

[75] Inventor: James E. Grinde, Anoka, Minn.

[73] Assignee: Yamaha Hatsudoki Kabushiki Kaisha, Iwata, Japan

[21] Appl. No.: 183,767

[22] Filed: Apr. 20, 1988

[30] Foreign Application Priority Data

Apr. 24, 1987 [JP] Japan ..... 62-99975

[51] Int. Cl.[5] ..... B63H 5/12

[52] U.S. Cl. ..... 440/57; 440/900; 440/53

[58] Field of Search ..... 440/53, 61, 57, 62, 440/900, 75, 89

[56] References Cited

U.S. PATENT DOCUMENTS

| | | | |
|---|---|---|---|
| 3,186,374 | 6/1965 | Heidner | 440/75 |
| 3,628,492 | 12/1971 | Baldwin | 440/75 |
| 3,919,965 | 11/1975 | Ross | 440/53 |
| 4,334,872 | 6/1982 | Gaston | 440/61 |
| 4,645,463 | 2/1987 | Arneson | 440/57 |

FOREIGN PATENT DOCUMENTS

| | | | |
|---|---|---|---|
| 468827 | 7/1914 | France | 440/53 |

*Primary Examiner*—Joseph F. Peters, Jr.
*Assistant Examiner*—Edwin L. Swinehart
*Attorney, Agent, or Firm*—Orrin M. Haugen; Thomas J. Nikolai; Frederick W. Niebuhr

[57] ABSTRACT

An outboard motor for a marine craft which incorporates a surface drive heretofore only found with inboard motors. A specially designed constant velocity universal joint is used to pivotally couple the propeller shaft and propeller shaft extension housing to the outboard's lower unit whereby propeller thrust forces are transmitted directly through the propeller shaft to the transmission's output shaft. Furthermore, provision is made for routing engine cooling water and exhaust through the prop shaft extension housing and the propeller hub, thereby reducing the engine noise.

9 Claims, 3 Drawing Sheets

SURFACE DRIVE OUTBOARD WITH IMPROVED TRANSMISSION

BACKGROUND OF THE INVENTION

I. Field of the Invention: This invention relates generally to an outboard motor drive system for a marine craft and more particularly to an improved outboard motor design incorporating a surface drive to enhance the performance characteristics thereof.

II. Discussion of the Prior Art: A typical, prior art, outboard motor assembly for a marine craft comprises a power head including an internal combustion engine, a vertical drive shaft and a lower unit, including a transmission and propeller shaft assembly and which is attached by suitable brackets to the transom of the craft. The downwardly extending engine drive shaft, the transmission and the propeller shaft are contained within a housing, the lower end of which extends below the keel of the boat such that, when operating, the propeller is totally submerged. Steering is accomplished by pivoting the motor assembly about a vertical axis running through the transom mounting bracket.

Another form of drive for a marine craft is a so-called stern drive or inboard/outboard drive. In this drive arrangement, the engine is located totally within the hull of the craft and the engine's shaft extends through the transom and is coupled to a transmission and comprising two bevel gears and an intermediate vertical shaft housed in a gear case and used to transmit the engine's output to a propeller again located below the keel of the watercraft. Steering is accomplished by rotating the external unit (outdrive) relative to a vertical axis passing through a mounting bracket attaching it to the transom of the vessel. Typical outdrive arrangements ar shown in the Bergstedt Patent No. 2,977,923, the Hurst Patent No. 3,893,407 and the Lohse Patent No. 3,888,203. In these prior art arrangements, the lower unit extends below the bottom of the boat's keel and thus create a drag which detracts from the forward speed and overall performance of the boat.

More recently, several articles have been published in various boating magazines describing the surface drive invention of Howard Arneson. In such a surface drive, the engine's output shaft is made to pass through the lower portion of the boat's transom in a generally horizontal disposition and is coupled through a universal joint to a propeller shaft which is journaled for rotation within a propeller shaft extension housing. A ball joint surrounds the universal joint which permits limited vertical and horizontal pivoting of the prop shaft extension housing to permit it to be tilted in a vertical plane or to be used for steering by shifting its position in a horizontal plane. The surface drive is configured so that approximately one-half of the propeller is above the surface of the water and the entire outdrive is disposed above the bottom of the boat's keel. As such, the outdrive does not create an appendage drag to adversely impact the craft's performance.

The specifics of the Arneson surface drive may be discerned from reading the Arneson U.S. Pat. No. 4,544,362. The Adams et al Patent No. 3,933,116 cited in the aforereferenced Arneson patent is also of interest as it relates to a surface drive assembly for use with an inboard engine on a marine craft.

SUMMARY OF THE INVENTION

The present invention adapts the surface drive concept to an outboard marine engine. More particularly, and in accordance with the present invention, the internal combustion engine comprising the power head of the motor is located exterior to the hull of the craft and is supported from the transom of the craft by a suitable transom mounting bracket. The engine's drive shaft is journaled in and extends through a exhaust extension housing and located at the lower end thereof is a transmission comprising forward and reverse bevel gears cooperating with a drive pinion affixed to the engine's shaft. The forward and reverse bevel gears are, in turn, splined to the transmission shaft which extends in a generally horizontal direction. Pivotally joined to the lower end of the exhaust extension housing by means of a constant velocity U-joint is the propeller shaft which is journaled for rotation within a prop shaft extension housing. The prop shaft extension housing is thus free to pivot under control of suitable linear actuators in the tilt and steering directions. The outboard engine of the present invention is designed such that the propeller is only half submerged and the lowermost point on the outboard is above the bottom of the boat's keel.

In carrying out the invention, a conventional constant velocity U-joint is modified such that the thrust forces developed by the propeller are transmitted, colinearly, directly from the propeller shaft to the transmission shaft rather than through the outer race of the constant velocity U-joint. In this fashion, the overall dimensions of the constant velocity U-joint can be reduced, allowing a sleeker, streamlined profile for the prop shaft extension housing than would otherwise be permitted.

Provision is also made for routing the engine's exhaust through the prop shaft extension housing and propeller hub, leading to more quiet operation.

OBJECTS

It is accordingly a principal object of the present invention to provide an improved outboard motor unit for a marine craft.

Another object of the invention is to provide an outboard motor for a marine craft which incorporates a surface drive configuration.

Yet another object of the invention is to provide a surface drive outboard motor for a marine craft incorporating a constant velocity universal joint for coupling the motor's transmission output shaft to a propeller shaft whereby the propeller shaft is capable of being pivoted in both the horizontal and vertical direction.

Yet another object of the invention is to provide a surface drive outboard motor for a marine craft which incorporates a constant velocity U-joint for coupling the transmission output shaft to the propeller shaft and in which thrust forces developed by the propeller are transmitted directly and co-linearly along the propeller shaft and the transmission output shaft.

Still another object of the invention is to provide an outboard engine for a marine craft having a surface drive and including means for routing exhaust and engine noise through the propeller hub.

The foregoing features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
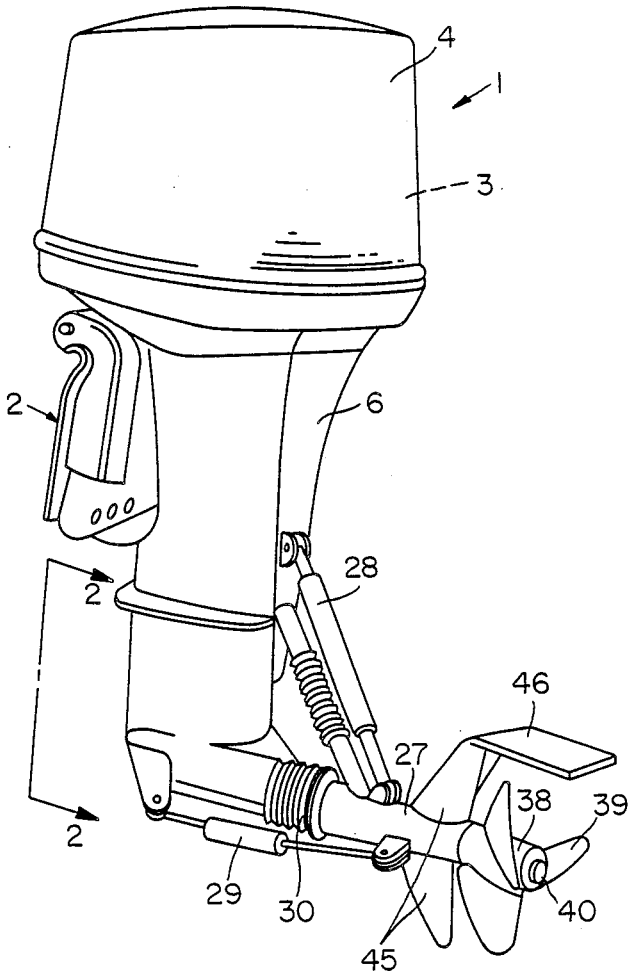
FIG. 1 is a perspective view of an outboard motor for a marine craft.

Referring to FIG. 1, there is illustrated a perspective view of an outboard motor for a marine craft which is indicated generally by numeral 1 and which incorporates the surface drive feature of the present invention. The surface drive outboard motor 1 includes a conventional transom bracket 2 whereby the motor can be suspended from the stern of a marine craft. While not specifically shown in the view of FIG. 1, the motor typically includes a power head 3 contained within a decorative shroud or casing 4 and a lower leg assembly 4*a* comprising an exhaust extension housing 6 and a lower gear case 6*a*.

Figure 2:
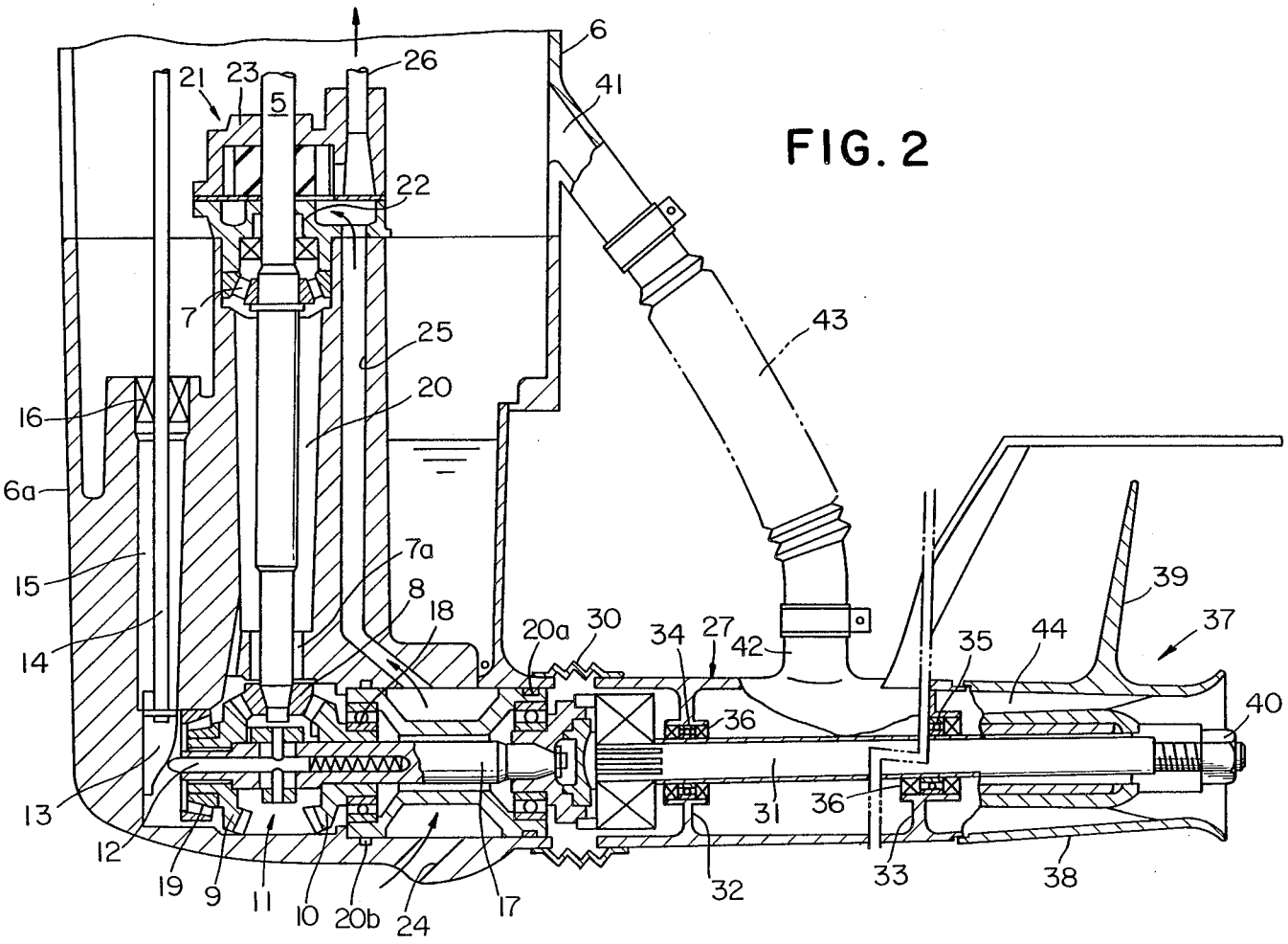
FIG. 2 is a partial cross-sectional view taken along the line 2—2 in FIG. 1.

Referring to FIG. 2, extending downwardly from the power head is the engine's drive shaft 5 which is journaled for rotation within the gear case housing 6*a* by a tapered upper roller bearing 7 and a lower roller bearing 7*a*. Attached to the lower end of the drive shaft 5 is a drive pinion gear 8 which is arranged to engage either the forward bevel gear 9 or the reverse bevel gear 10 upon actuation of the shift dog 11 by way of the shift plunger 12 which cooperates with the shift cam 13 affixed to the lower end of a shift linkage rod 14. The shift linkage rod 14 is contained within a tubular bore 15 formed in the gear case housing 6*a*, that bore being filled with oil and equipped with a seal 16 which is effective to block the entrance of cooling water into this oil-filled passage.

The forward and reverse bevel gears 9 and 10 are journaled to the transmission output shaft 17, that shaft being journaled for rotation in the lower portion of the gear case housing 6*a* by means of bearing assemblies 18 and 19.

The vertical cavity 20 in the gear case housing 6*a* accommodating the drive shaft 5 is also filled with lubricating oil whereby the entire transmission including the bearings 7 and 7*a*, the pinion 8 and the bevel gears 9 and 10 as well as the shift plunger 12 and transmission shaft bearings 18 and 19 are immersed in oil. Again, oil seals as at 20*a* and 20*b* isolate the chambers flooded with oil from those receiving water.

With continued reference to FIG. 2, it can also be seen that a water pump assembly 21 contained within the exhaust extension housing 6 surrounds the shaft 5 and is driven thereby. More particularly, the impeller 22 of an impeller-type water pump is contained within a pump housing 23 so as to be driven by the engine shaft 5 for drawing floatation water through an inlet port 24 in the base of the gear case housing 6*a* and through a passageway 25 to the inlet of the water pump 21 and from there the cooling water is made to flow through the passageway 26 leading to the conventional water cooling passages of the internal combustion engine contained within the power head 3.

In a conventional outboard engine for a marine craft, the drive propeller will normally be attached directly to the shaft 17. In the surface drive arrangement of the present invention, a prop shaft extension housing 27 is pivotally secured to the gear case housing 6*a*, as best seen in FIG. 1, and a pair of linear actuators 28 and 29 are employed to provide tilt and steering forces to the prop shaft extension housing. The linear actuators are preferably hydraulic in nature, but conceivably can be pneumatic or electric. An accordion pleated elastomeric boot 30 encloses and seals the joint between the prop shaft extension housing 27 and the lower end of the gear case housing 6*a* as illustrated.

Journaled for rotation within the prop shaft extension housing is the propeller shaft itself and which is identified by numeral 31. Specifically, contained within the prop shaft extension housing 27 are bearings supports 32 and 33 which contain bearing assemblies 34 and 35 which are sandwiched between shaft seals 36. A surface drive propeller 37 having a hub 38 and radiating propeller blades 39 is secured to the end of the prop shaft 31 by a threaded nut 40.

With reference to FIG. 2, an exhaust/cooling water discharge port 41 is formed through the exhaust extension housing 6 while a similar exhaust/cooling water inlet port 42 extends through the exterior wall of the prop shaft extension housing 27. A length of flexible hosing 43 is used to join the discharge port 41 to the inlet port 42 such that exhaust gases from the internal combustion engine and cooling water discharged therefrom pass through the flexible tube 43 and through ports 44 formed through the propeller hub 38. In this fashion, exhaust fumes, noise and cooling water are discharged through the prop adding considerably to the noise suppression of the engine.

Extending radially from the exterior of the prop shaft extension housing 27 are upper and lower stabilizing fins 45 and secured to the uppermost stabilizing fin and extending above the propeller 38 is a spray deflector plate 46.

In accordance with the present invention, the transmission output shaft 17 is coupled to the propeller extension shaft 31 by means of a constant velocity U-joint of the type manufactured by the Con-Vel plant of the Dana Corporation of Detroit, Mich. This U-joint is indicated generally in FIG. 3 by numeral 45 and includes a drive collar 46 which is fastened to the transmission output shaft 17 by a splined connection on the shaft and a nut 63 screwed onto a threaded rod 17*a* extending from the end of the transmission shaft 17. The drive collar is journaled for rotation within the gear case housing 6*a* by bearings 47. It is welded to an adapter ring 48 as shown at 49 and a series of bolts, as at 50, are used to secure the outer race member 52 of the constant velocity U-joint 45 to the adapter ring 48. The inner surface of the outer race is provided with a plurality of spherical grooves 53 for receiving a plurality of spherical drive balls 54 which are held in place by means of an annular ball cage 55. The constant velocity U-joint also includes an inner race 56 which comprises a segment of a sphere of a predetermined radius. Formed in the surface of the sphere 56 are spherical grooves dimensioned to also receive the drive balls 54 therein. The inner race 56 is splined to the prop shaft 31 and, thus, the rotational force imparted by the transmission shaft 17 to the outer race 52, via the drive collar 46 and the adapter ring 48 is transmitted to the propeller shaft 31 by the drive balls 54. The shaft 31 is able to pivot relative to the shaft 17, allowing the linear actuators 28 and 29 to impart tilt and steering movements to the prop shaft extension housing 27 as indicated by the doubled-headed arrows 57 shown in FIG. 3.

Figure 3:
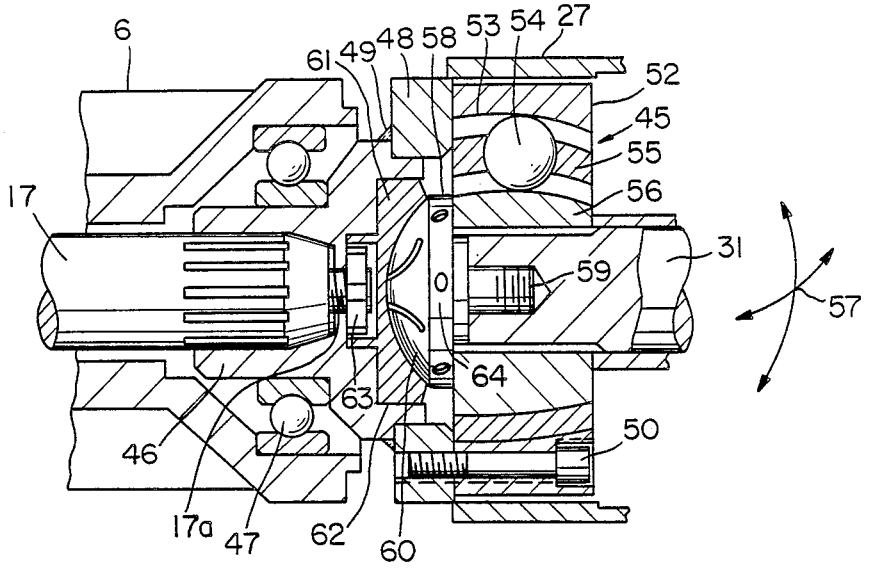
FIG. 3 is an enlarged view of the constant velocity joint used for coupling the propeller shaft to the transmission output shaft.

An important aspect of the present invention is that the thrust forces developed by the propeller 39 and imparted to the propeller shaft 31 are transferred directly and colinearly to the transmission shaft 17, rather than indirectly through the outer race 52 and the adapter ring 48 of the constant velocity U-joint assembly 45 or through the housing 6 to the marine craft. To achieve this direct, colinear thrust-force transfer, a thrust ball member 58 is fastened to the prop shaft 31 by a threaded stud 59 while the spherical surface thereof 60 cooperates with a spherical concave recess formed in a thrust socket member 61. As illustrated in FIG. 3, the thrust socket 61 fits within a cylindrical bore 62 of the drive collar 46 and includes an annular flange cooperating with a splined nut 63 which is used to hold the drive collar 46 onto the transmission shaft 17. The curved surface of thrust ball 60 is designed to lie on the same radius as the centers of the drive balls 54 and, as such, any tilt and steering motion imparted to the prop shaft extension housing 27 results in intimate ball-socket engagement and a direct transfer of the propeller thrust from the propeller drive shaft 31 through the thrust ball 58, the thrust ball socket 61 to the transmission shaft 17. Because the thrust forces are accommodated in the fashion indicated, there is no need to provide substantial bulk in the constant velocity U-joint members 52, 54 and 56. Hence, the lower gear case housing and the prop shaft extension housing 27 can be of a reduced diameter compared to what would otherwise be required if the thrust forces of the propeller were to be transferred through the outer race 52 of the constant velocity joint 45. A smaller diameter housing 27 cuts down on the appendage drag of the motor and improves the performance of a surface drive.

A series of radial bores as at 63 are formed in a side surface of the thrust ball 60 and these radial bores are in fluid communication with grooves formed in the spherical face of the thrust ball. In this fashion, lubricating oil flooding the volume occupied by the constant velocity joint 45 is distributed over the mating surfaces of the thrust ball 60 and thrust socket 62 to reduce friction and heating at surface locations not moving at the same relative angular velocity during tilt/steering maneuvers.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and operating procedures, can he accomplished without departing from the scope of the invention itself.

What is claimed is:

1. A surface drive motor for propelling marine craft comprising:

(a) a power head including motor means, said motor means including a generally vertical engine output shaft;

(b) case means surrounding said power head and said motor means output shaft, said casing being adapted to be affixed to the transom of said marine craft;

(c) transmission means contained in said casing means for selectively coupling the lower end of said motor output shaft to a first end of a transmission output shaft having first and second ends;

(d) a universal joint coupled to said transmission output shaft so as to be driven thereby; and (e) a propeller shaft affixed to said universal joint so as to be free to pivot both vertically and laterally at said universal joint over a predetermined angle.

2. The surface drive outboard motor as in claim 1 and further including:

(a) a prop shaft extension housing surrounding said universal joint and said propeller shaft; and (b) flexible boot means for forming a waterproof covering between said casing means and said prop shaft extension housing.

3. The surface drive outboard motor as in claim 1 and further including:

(a) thrust socket means affixed to said second end of said transmission output shaft, said thrust socket means including a spherical concave face; and (b) thrust ball means attached to said propeller shaft and having a convex surface conforming to said concave surface of said thrust socket means for transmitting propeller thrust forces directly through said universal joint to said transmission output shaft, thereby isolating said universal joint from said thrust forces.

4. The surface drive outboard motor as in claim 2 and further including first and second linear actuator means coupled between said casing means and said prop shaft extension housing for tiltably and steerably pivoting said prop shaft extension housing.

5. The surface drive outboard motor as in claim 2 wherein said motor means comprises an internal combustion engine which is adapted to be cooled by water flowing through said power head.

6. The surface drive outboard motor as in claim 5 and further including:

(a) a cooling water inlet port extending through said casing means proximate the lower end thereof;

(b) a water pump attached to said motor means output shaft and having an inlet in fluid communication with said water inlet port in said casing and an outlet adapted to be in fluid communication with said internal combustion engine;

(c) an exhaust and cooling water discharge port formed in said casing;

(d) an exhaust and cooling water inlet port formed in said prop shaft extension housing; and (e) flexible tubing means coupled between said discharge port and said inlet port.

7. The surface drive outboard motor as in claim 5 and further including a propeller hub secured to said propeller shaft, said hub including exhaust and cooling water discharge passages extending therethrough.

8. The surface drive outboard motor as in claim 3 wherein said universal joint comprises a constant velocity joint including:

(a) an inner race member having a spherical surface, said surface including arcuate, ball-receiving grooves;

(b) an outer race member having arcuate, ball-receiving grooves formed on an internal surface thereof;

(c) a plurality of spherical ball bearings disposed individually in the ball-receiving grooves of said inner race member and said outer race member;

(d) a ball-retaining cage disposed between said inner race member and said outer race member for holding said ball bearings in predetermined registration;

(e) said outer race member being fixedly attached to said second end of said transmission output shaft and said inner race member being fixedly attached to said propeller shaft.

9. The surface drive outboard motor as in claim 7 wherein said thrust ball attached to said propeller shaft has the same radius of curvature as said spherical surface of said inner race member on said constant velocity universal joint.

* * * * *